US005345950A

United States Patent [19]

Adebahr et al.

[11] Patent Number: 5,345,950

[45] Date of Patent: Sep. 13, 1994

[54] APPARATUS FOR APPLYING STARCH PASTE TO TOBACCO ARTICLES

[75] Inventors: Herbert F. Adebahr, Greensboro; Derek P. Noakes, Pleasant Garden; Mark E. Coby, Kernersville, all of N.C.

[73] Assignee: Lorillard Tobacco Company, New York, N.Y.

[21] Appl. No.: 17,981

[22] Filed: Feb. 12, 1993

Related U.S. Application Data

[63] Continuation of Ser. No. 558,138, Jul. 25, 1990, abandoned.

[51] Int. Cl.[5] ..... A24C 5/24

[52] U.S. Cl. ..... 131/69; 131/67

[58] Field of Search ..... 131/37, 69, 67, 90, 131/280; 118/683

[56] References Cited

U.S. PATENT DOCUMENTS 2,660,177 11/1953 Rault .
2,660,178 11/1953 Rault .
2,938,521 5/1960 Lanore .
3,030,965 4/1962 Labbe .
3,030,966 4/1962 Lanore .
3,088,467 5/1963 Lanore .
3,088,468 5/1963 Labbe .
3,105,498 10/1963 Best .
3,548,836 12/1970 Dreher ..... 131/280
4,776,351 10/1988 Wahle et al. ..... 131/69
5,056,462 10/1991 Perkins et al. ..... 118/683

FOREIGN PATENT DOCUMENTS 2038450 2/1979 Fed. Rep. of Germany .
1422045 11/1963 France .
0927927 6/1963 United Kingdom .

*Primary Examiner*—Jennifer Bahr
*Attorney, Agent, or Firm*—White & Case

[57] ABSTRACT

A method and apparatus, which are utilized in cigarette making machinery, for applying starch paste for sealing the edges of cigarette paper includes a pencil paster nozzle, means for supplying starch paste under pressure, and a high precision metering pump for regulating the flow of paste to the nozzle. The metering pump operates as a function of line speed.

23 Claims, 4 Drawing Sheets

APPARATUS FOR APPLYING STARCH PASTE TO TOBACCO ARTICLES

This application is a continuation of application Ser. No. 558,138, filed on Jul. 25, 1990, abandoned upon the filing of this application.

BACKGROUND OF THE INVENTION

In the manufacture of cigarette articles, tobacco is dispensed onto a moving belt or web, where it is shaped into a continuous rod. As the rod moves along the cigarette making apparatus, its brought into contact with a continuous length of cigarette paper, moving at the same speed. Various guides on the machinery fold one edge of the paper to wrap it around the tobacco rod, but leave the opposite edge, or "lap" standing upright so as to be exposed. At this point, glue is applied to the inside surface of the exposed edge portion, and thereafter machine guides fold the exposed edge portion so as to overlap the opposite edge of the paper, the glue thus adhering the opposite edges of the paper together.

Traditionally, the preferred glue for cigarette applications is starch paste. For starch paste to effectively seal the ends of the cigarette paper, however, it is necessary to apply the paste in a uniform, thin layer of a controlled amount.

At one time in the industry, paste was applied to the paper by dispensing it through a nozzle using pressure to control the volume. This worked for relatively slow speed machinery. But, as cigarette making machines became faster, machinery manufacturers replaced nozzle applicator systems with a paste wheel system, such as disclosed in U.S. Pat. No. 3,105,498, in order to improve the application of the paste on faster machines.

Conventional starch paste applicators, such as the Molins Mark IX starch paster, continue to use a paste wheel applicator. In the Molins apparatus, starch paste is supplied from a starch pot, which includes a moveable piston plate closing one end. A hydraulic ram, acting on the piston plate, forces paste from the starch pot, through a connecting line, to a paster nozzle. The nozzle is spring loaded against a concave wheel so as to apply a film of starch. The concave wheel, in turn, is in contact with the paste wheel so as to transfer paste to the paste wheel. Finally, the paste wheel contacts the cigarette paper lap so as to transfer paste to the cigarette paper.

The use of the double paste wheel transfer is intended to ensure that a uniform, controlled amount of paste is applied at the correct position to the paper lap. However, in order to function properly, the paste wheel system components must be adjusted to very close tolerances. Thus, the spring pressure on the nozzle must be adjusted to suit the consistency of the starch in use. The height of the paste wheel relative to the concave wheel must be set to ensure that the correct transfer of starch is achieved. The paste wheel periphery and concave surface of the concave wheel must be set parallel to and in contact with each other. Also, the paster position must be adjusted to apply the starch correctly onto the cigarette lap. In practice, the need for close adjustment tolerances causes a considerable amount of defective product ("pop opens") and down time of the cigarette making machinery. Also, the paste wheel systems include several high wear items. These items are expensive to replace, due to the precision required in machining the parts.

As cigarette making equipment improves, it would be desirable to operate at still higher speeds. However, the known starch paste applicator systems have proven inadequate for higher speed operations.

Because of the high incidence of defective products, or in order to speed up the manufacturing line, some manufacturers have switched from starch paste to a PVC-type of sealant. It would be desirable, however, to have a system capable of applying starch paste with better consistency, which is easier to adjust and operate, and which can function efficiently at higher speeds. It would also be desirable to reduce maintenance costs relative to the paste wheel systems.

SUMMARY OF THE INVENTION

The present invention is an apparatus, and associated method, for applying starch paste to tobacco wrapping paper using a pencil paste nozzle, which apparatus precisely regulates the pressure and flow rate of starch paste. According to the present invention, it is possible to apply starch paste directly from a nozzle to the cigarette paper lap at high speed, with great uniformity, and using a paste applicator system that requires minimum maintenance.

More particularly, the present invention is a method and apparatus for applying starch paste to the edge or lap of a cigarette paper. A paste nozzle is mounted to a machine which folds a continuous length of cigarette paper about a tobacco rod, in a manner so as to expose one edge of the paper, i.e. the "lap." The nozzle outlet is positioned adjacent to the lap to apply paste to the inside surface of the lap as the paper moves past the nozzle.

Means, such as the known paste pot and activating ram, supply starch paste to a high precision metering pump. The metering pump, in turn, supplies paste to the nozzle at a rate and pressure which is controlled responsive to the operating speed of the cigarette making machine. Preferably, the metering pump is a mechanically driven, variable speed, fixed displacement pump, and is driven through a gear reducer off the making machine such that the pump speed is proportional to the line speed.

Preferably, one or more dust hoods are positioned just up line of the paster nozzle. Also, preferably a compressed air nozzle is directed at the tip of the paster nozzle. This acts to keep the nozzle tip clear of any loose tobacco particles that escape the dust hoods, and also cools the nozzle.

The preferred nozzle according to the invention includes a nozzle tip which is elongated in a direction perpendicular to the direction of paper movement. The nozzle has a bore of a cross section that permits the paste to flow from the nozzle at relatively little pressure drop, at a flow rate that will maintain a continuous film on the paper.

For a better understanding of the invention, reference is made to the following detailed description of a preferred embodiment, taken in conjunction with the drawings accompanying the application.

DETAILED DESCRIPTION OF A PREFERRED EMBODIMENT

Figure 1:
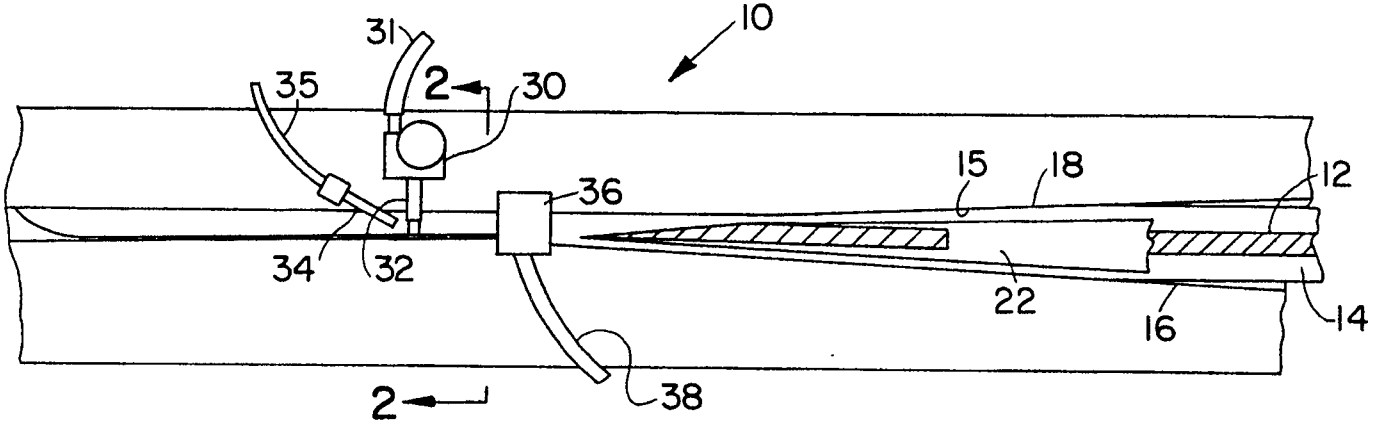
FIG. 1 is a top, schematic view of a portion of a cigarette making machine showing the paster nozzle.
Figure 2:
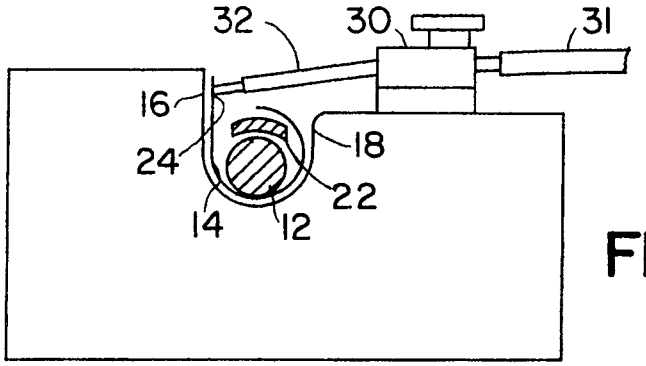
FIG. 2 is a sectional view taken through lines 2—2 of FIG. 1.

FIG. 1 shows a portion of a cigarette making machine 10 generally referred to as the garniture. FIG. 2 shows a sectional view of the portion containing the novel paste nozzle according to the invention.

The exemplary cigarette making machine 10 may be generally as shown and described in U.S. Pat. No. 3,105,498. A continuous tobacco rod 12 and wrapping paper 14 are moved along machine 10 (in the direction toward the left) in a groove 15 formed by a pair of converging guides 16, 18. The bottom of the groove 15 is arcuate shape and the guides 16, 18 act to gradually fold the paper 14 in a circular shape about the tobacco rod 12. A tongue 22 is provided to isolate the tobacco from the overhanging paper in the initial stages as it is folded.

Eventually, as shown in FIG. 2, the guides 16, 18 expose one edge, or lap 24, in an upright position, such that paste can be applied. Once the paste is applied, the ends of the paper 14 are folded about the tobacco rod 12 with the adhesive on lap 24 sealing the ends of the paper together. The foregoing type of garniture, with the exception of the novel paste applicator system of the present invention (described below), is well known, and any type of suitable garniture may be used with the present invention.

As shown in FIGS. 1–2, a paste nozzle assembly 30, which receives starch paste through a feed line 31, is mounted on machine 10, and positioned such that the paste nozzle 32 is directed at the inside surface of the exposed lap 24 of paper 14. The nozzle 32 is positioned so that the tip is in contact with the paper. In addition, a compressed air nozzle 34, supplied through air line 35, is directed at the paste nozzle 32. Finally, one or more dust hoods 36 are positioned up line of the paste nozzle 32 for removing loose tobacco through a suction line 38.

Figure 3:
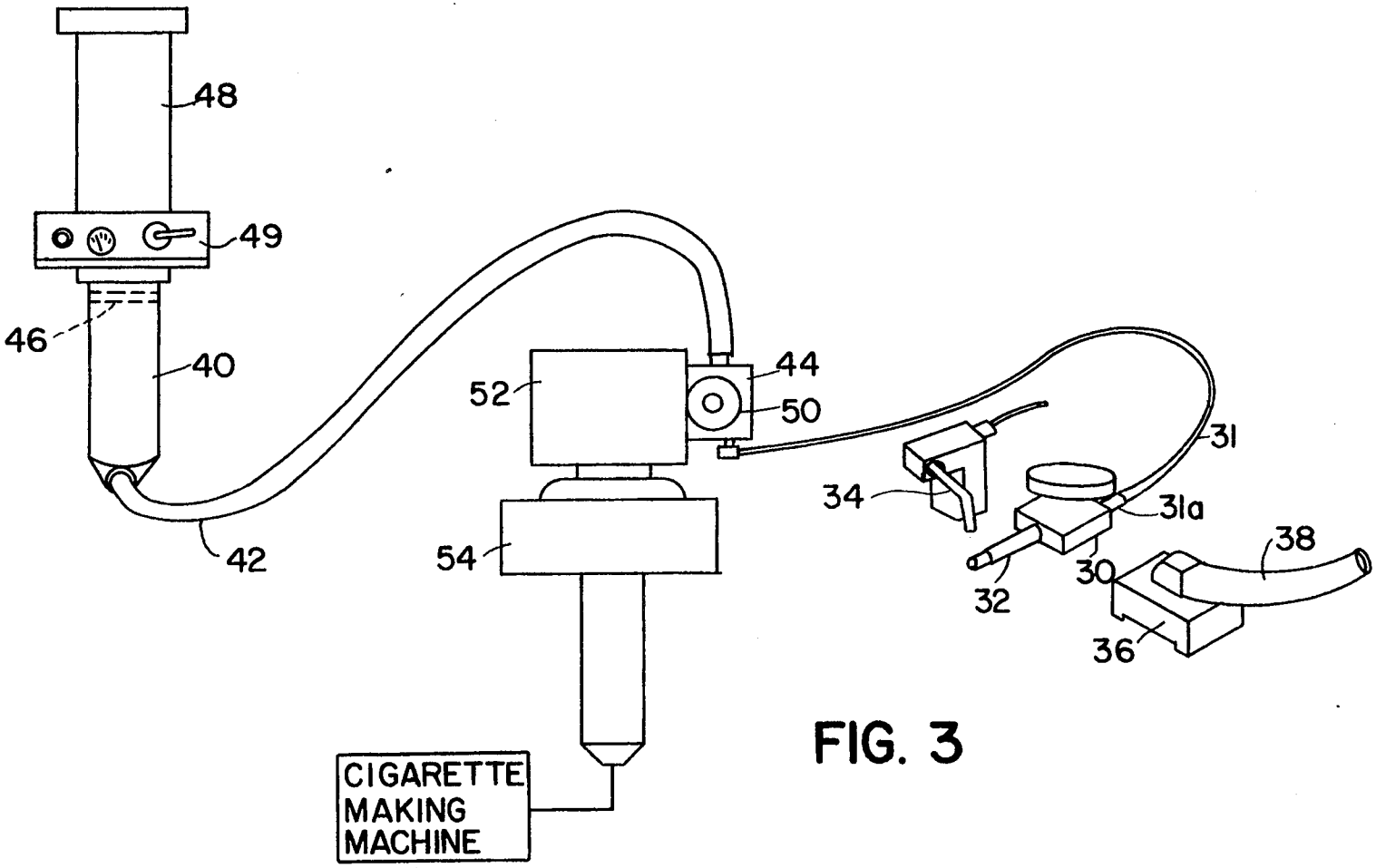
FIG. 3 is a schematic view of the components of the paster system according to the invention.

Referring to in FIG. 3, starch paste is supplied from a paste pot 40 through a supply line 42 to a metering pump 44. Paste pot 40 may be the same as the known paste pot assemblies used with the Molins Mark IX, in which one end includes a moveable piston plate 46. As shown in FIG. 3, a pneumatic ram 48 presses against the piston plate 46 to push paste out through supply line 42. By use of a pneumatic drive, paste is extruded from the paste pot and supplied to the metering pump 44 at a constant pressure. The ram includes appropriate controls 49 for varying ram pressure and for retracting the ram (in order to change paste pots). The supply line 42 is preferably connected to the paste pot by a quick connect coupling to facilitate changing paste pots.

Metering pump 44 is preferably a high precision spinning pump having an output proportional to speed, such as Feinpruf model SPSO582AAZ,N19 having a capacity of 0.6 cc/rev. The pump is provided with a manual feed wheel 50, which is used to bleed air from the paste line when paste pots are changed.

Metering pump 44 is driven by a gear reducer 52, which is connected to a gear drive 54. A gear reducer such as Browning model SM133C1 may be used. Gear drive 54 is connected to the drive of the cigarette making machine, as indicated schematically, so as to have a rotational speed proportional to the speed of the maker, i.e. proportional to the speed of the moving cigarette paper and tobacco rod. Any suitable gear, pulley, chain or other connection may be used. Existing Molins Mark IX equipment has a gear drive, and such may be used in the present invention to drive the gear reducer 52.

Figure 4:
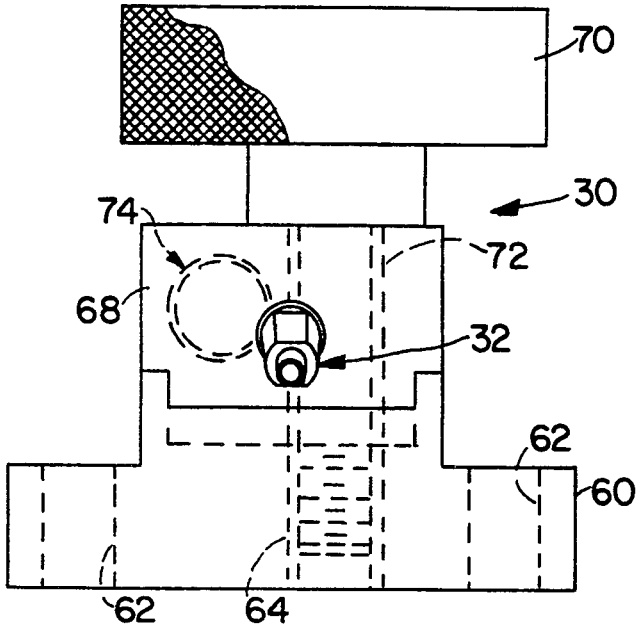
FIG. 4 and 5 are front and side views, respectively, of a nozzle assembly according to the invention.
Figure 5:
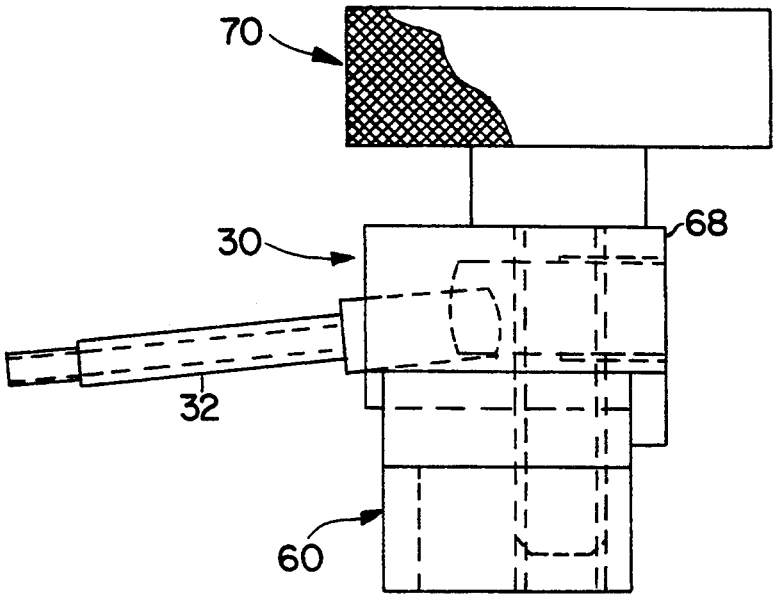

Referring to FIGS. 4–5, which show an example of a paste nozzle assembly 30, a mounting block 60 includes a pair of holes 62, which may be used to attach the block 60 to the garniture 10, and a threaded hole 64 for securing the upper part of the assembly. The upper face of the block 60 includes guides 66 for seating a nozzle housing 68, described further below. Nozzle housing 68 is secured to the mounting block 60 by a knurled fastener 70, the threaded shaft of which extends through a bore 72 in the nozzle housing 68 and is screwed into the threaded hole 64 in the mounting block. This permits the nozzle housing to be removed easily when desired, and to be re-mounted precisely in position.

Figure 6:
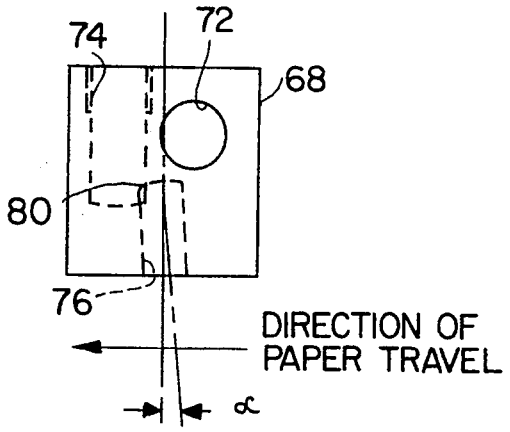
FIGS. 6, 7, and 8 are top, front, and side views of the nozzle mounting block of FIGS. 4–5.
Figure 7:
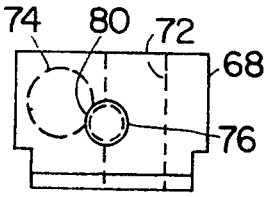
Figure 8:
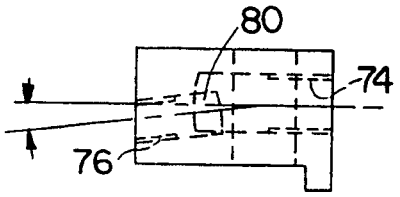

As shown in FIGS. 6–8 the nozzle housing 68, which is preferably brass, includes, in addition to bore 72, a threaded intake hole 74 and a threaded nozzle mounting hole 76. The intake hole 74 and nozzle mounting hole 76 communication with one another in the region indicated 80. The holes 74, 76 are laterally offset from one another, since they are oriented at different angles, and this also allows room for bore 72. The bottom of the housing 68 includes laterally opposed cutouts, that cooperate with the seating guides 66 in the mounting block 60.

Hole 74 is threaded so as to receive a threaded coupling 31*a* from the metering pump supply line 31, whereas the hole 76 is threaded to receive the threaded end of the nozzle. As shown in FIGS. 5 and 8, the hole 76 is angled down about 6° relative to horizontal to point the nozzle down. The purpose of this is to match the angle of the paper, which in the Molins Mark IX machine is at a slight angle to vertical. By orienting the nozzle in this manner, the tip of the nozzle is perpendicular to the paper. If used in equipment where the lap is a different angle, the angle of the nozzle should be adjusted accordingly so that the nozzle tip remains perpendicular to the paper. Also, as shown in FIG. 6, in the horizontal plane the nozzle hole 76 is not exactly perpendicular to the direction of paper travel, but rather is angled about 6°–7° back away from the direction of paper travel, i.e., so as to lie at about 83° to 84° relative to the direction of paper travel, which has been found to improve the application of paste.

Figure 10:
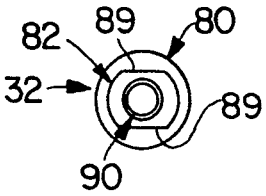
FIGS. 9 and 10 are side and front views, respectively, of a nozzle according to the invention.
Figure 9:
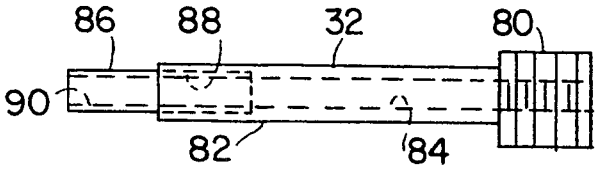

Referring to FIGS. 9–10, a pencil paster nozzle 32 according to the invention preferably is made of stainless steel and includes a threaded end 80, which is screwed into the nozzle mounting hole 76. The dimensions of the nozzle bore are selected so that the paste flows from the nozzle at relatively low pressure, at a flow rate that will maintain a continuous film on the paper. The cross-sectional flow area through the nozzle bore is sufficient so that the paste flows from the nozzle at a relatively low velocity, to allow the nozzle to remain in contact with the paper.

In an illustrative example, the threaded end 80 and nozzle tube 82 include a 5/65" bore 84 therethrough, except that at the outer end of the nozzle tube 82 the bore is enlarged to 7/64" for a distance of ¼" from the tip. A nozzle tip 86, which has an outside diameter matching the enlarged end bore 88 of tube 82 (i.e. 7/64"), is press fit into the enlarged end bore 88. The tip 86 includes an internal bore 90 therethrough of the same diameter as the tube bore 84, i.e. 5/64". As shown in FIG. 10, opposite sides 92 of the nozzle tube 82 have flats 89, to permit the use of a wrench when tightening the nozzle assembly in the hole 76.

Figure 11:
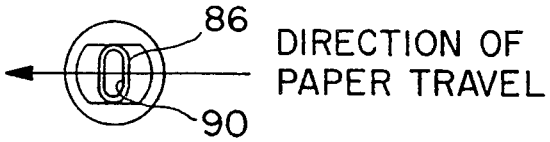
FIG. 11 is a front view of the nozzle of FIG. 11, in which the tip has been made elongated in preparation for use.

As shown in FIG. 11, prior, to using the nozzle, it has been found preferable to squeeze the tip to make it oblong, e.g. with a dimension of 3.8 mm×2.0 mm, with the longer dimension oriented perpendicular to the direction of paper travel. By thus elongating the nozzle tip, it has been found that a more uniform application of paste is achieved then in the case of a round tip.

To set up the apparatus, the tip 86 of the nozzle 32 is initially polished in the direction of paper traveling using crocus cloth TR3. The purpose of this is to remove small grooves through which leakage could occur. The threaded end 80 of the nozzle 32 is then screwed into the nozzle housing 68, together with the supply line connector 31*a*. As noted above, the longer dimension of the oblong nozzle tip should be positioned vertically, perpendicular to the direction of paper travel. The housing 68 is positioned on the mounting block 60 and secured in place by the knurled fastener 70.

To initialize the flow of paste, a paste pot 40 is installed in the pneumatic ram assembly and the ram is actuated. The manual feed wheel on the metering pump 44 is then turned to feed paste to the nozzle 32 until such time as air is removed from the supply lines. At such time, the cigarette making machine can be started, and paste will be supplied by the metering pump 44, at the appropriate rate depending on machine speed.

As the paper moves, it rubs up against the nozzle. The characteristics of the metering pump, gear reducer, pneumatic ram, and nozzle, are selected so that paste flows out of the nozzle tip at a relatively low pressure, at a rate (speed dependent) at which it will form a thin uniform film on the paper. By using a system according to the invention, it is possible for a particular type of paste, to provide sufficiently accurate control to ensure that the paste flows from the nozzle in an amount that will maintain a continuous film on the paper, and avoid excess delivery (which is undesirable) or insufficient delivery (which would cause discontinuities in the film and result in pop opens).

The pneumatic ram pressure is set to ensure a sufficient flow of paste to the metering pump. If, due to batch-to-batch variance in paste consistency, insufficient paste is delivered to the pump, the ram pneumatic pressure is increased to compensate.

The foregoing is a preferred embodiment of the invention. Variations and modifications will be apparent to persons skilled in the art, without departing from the inventive principles disclosed herein. All such modifications and variations are intended to be within the scope of the invention, as defined in the following claims.

We claim:

1. In a high speed machine for folding and sealing a continuous length of cigarette paper about a tobacco rod, including garniture means for exposing one edge of the paper to define a lap, and means for applying a starch paste to the lap prior to sealing, the improvement wherein the means for applying a starch paste comprises:

a paster nozzle having an outer tip positioned to be in contact with the lap of the cigarette paper for applying paste along the lap; means for supplying starch paste to a metering pump means at a controlled pressure; a high precision metering pump means for receiving paste from the paste supplying means and for supplying paste to said nozzle at a controlled rate, wherein said nozzle has an internal bore sized for delivering paste at a relatively low pressure and at a rate for applying a thin, uniform film of paste to the lap as the paper moves past said tip, and wherein said tip is elongated in cross-section and oriented such that the longer dimension is substantially perpendicular to the direction of paper movement.

2. A machine according to claim 1, wherein said nozzle has a reduced wall thickness at said tip, and wherein the portion of said tip positioned to contact the paper has been polished in the direction of paper movement.

3. A machine according to claim 1, wherein said nozzle is oriented at an angle of 83° to 84° relative to the direction of paper travel.

4. A machine according to claim 1, wherein the metering pump means comprises a high precision rotary pump, and means for coupling said pump to the machine for rotating proportional to the speed of said machine.

5. A machine according to claim 1, which includes means for varying operating speed, wherein said metering pump means includes means for supplying paste to said nozzle proportional to the machine operating speed.

6. In a high speed machine for folding and sealing a continuous length of cigarette paper about a tobacco rod, including garniture means for exposing one edge of the paper to define a lap, and means for applying a starch paste to the lap prior to sealing, the improvement wherein the means for applying a starch paste comprises:

a paster nozzle having an outer tip positioned to be in contact with the lap of the cigarette paper for applying paste along the lap; means for supplying starch paste to a metering pump means at a controlled pressure; a high precision metering pump means for receiving paste from the paste supplying means and for supplying paste to said nozzle at a controlled rate, wherein said nozzle has an internal bore sized for delivering paste at a relatively low pressure and at a rate for applying a thin, uniform film of paste to the lap as the paper moves past said tip; wherein said nozzle includes a nozzle tube, wherein said tip is secured in said nozzle tube and has a portion extending therefrom; wherein said tip has an outer dimension, in cross-section, less than said nozzle tube; and wherein said nozzle tube and tip have a continuous bore therethrough of uniform area.

7. A machine according to claim 6, wherein the portion of said tip positioned to contact the paper has been polished in the direction of paper movement.

8. A machine according to claim 6, wherein the extending portion of said tip is elongated in cross-section and oriented such that the longer dimension is substantially perpendicular to the direction of paper movement.

9. A machine according to claim 8, wherein the portion of said tip positioned to contact the paper has been polished in the direction of paper movement.

10. A machine according to claim 6, comprising a nozzle housing having means for receiving said nozzle; and mounting block means on said machine for releasably securing said nozzle housing at a preselected position and orientation.

11. Apparatus for applying starch paste to an exposed edge of moving cigarette paper, comprising:

a two-part paster nozzle comprising a nozzle tube and a relatively thin-walled outer tip having an outlet end positioned to be in contact with the exposed edge of the cigarette paper for applying paste along the exposed edge; means for supplying starch paste to a metering pump means; a metering pump means for receiving paste from the paste supplying means and for supplying paste to said nozzle at a controlled rate; wherein said nozzle has an internal bore sized for delivering paste at a relatively low pressure and at a rate for applying a thin, uniform film of paste to the exposed edge as the paper moves past said tip, and wherein said tip is elongated in cross-section and oriented such that the longer dimension is substantially perpendicular to the direction of paper movement.

12. Apparatus according to claim 11, wherein said nozzle is oriented at an angle of 83° to 84° relative to the direction of paper travel.

13. A machine according to claim 11, which includes means for varying operating speed, wherein said metering pump means includes means for supplying paste to said nozzle proportional to the machine operating speed.

14. Apparatus for applying a starch paste to an exposed edge of moving cigarette paper, comprising:

a two-part paster nozzle comprising a nozzle tube and a relatively thin-walled outer tip having an outlet end positioned to be in contact with the exposed edge of the cigarette paper for applying paste along the exposed edge; means for supplying starch paste to a metering pump means; a metering pump means for receiving paste from the paste supplying means and for supplying paste to said nozzle at a controlled rate, wherein said nozzle has an internal bore sized for delivering paste at a relatively low pressure and at a rate for applying a thin, uniform film of paste to the exposed edge as the paper moves past said tip; wherein said tip is secured in said nozzle tube and has a portion extending therefrom; wherein said tip has an outer dimension, in cross-section, less than said nozzle tube; and wherein said nozzle tube and tip have a continuous bore therethrough of uniform area.

15. Apparatus according to claim 14, wherein the portion of said tip positioned to contact the paper has been polished in the direction of paper movement.

16. Apparatus according to claim 14, wherein the extending portion of said tip is elongated in cross-section and oriented such that the longer dimension is substantially perpendicular to the direction of paper movement.

17. Apparatus according to claim 16, wherein the portion of said tip positioned to contact the paper has been polished in the direction of paper movement.

18. Apparatus according to claim 14, comprising a nozzle housing having means for receiving said nozzle, and mounting block means on said machine for releasably securing said nozzle housing at a preselected position and orientation.

19. Apparatus according to claim 14, wherein said nozzle tube has an enlarged bore extending from one end partially into said tube, and wherein part of the length of said tip is secured in said enlarged bore.

20. A method of applying paste to an exposed edge of moving cigarette paper, comprising:

providing starch paste at a preselected pressure to the inlet side of a high precision metering pump;

providing a nozzle, having an outer tip, having an internal bore sized for delivering paste at a relatively low pressure;

positioning the nozzle tip to be in contact with one edge of the moving paper; driving the metering pump at a preselected speed for supplying paste from the metering pump to the nozzle at a controlled rate for applying a thin, uniform layer of paste to the exposed edge as the paper moves past the tip, and further comprising the step, prior to providing paste to the nozzle, of squeezing the nozzle tip such that the bore through the tip is elongated and oriented perpendicular to the direction of paper movement.

21. A method according to claim 20, wherein the nozzle includes a nozzle tube and a thin, nozzle tip extending therefrom, and comprising the step, prior to providing paste to the nozzle, of polishing the nozzle tip in the direction of paper movement.

22. A method according to claim 20, comprising the step of applying paste while the nozzle is oriented at an angle of 83° to 84° relative to the direction of paper movement.

23. A method according to claim 20, comprising the step supplying paste to the nozzle at a rate proportional to the speed of the paper past the tip.

* * * * *